US010240366B2

(12) United States Patent
Sotes Delgado

(10) Patent No.: US 10,240,366 B2
(45) Date of Patent: Mar. 26, 2019

(54) ELECTRONIC LOCK

(71) Applicant: Ojmar, S.A., Elgoibar (ES)

(72) Inventor: Miguel Sotes Delgado, Elgoibar (ES)

(73) Assignee: Ojmar, S.A., Elgoibar (ES)

( * ) Notice: Subject to any disclaimer, the term of this patent is extended or adjusted under 35 U.S.C. 154(b) by 20 days.

(21) Appl. No.: 15/511,116

(22) PCT Filed: Sep. 11, 2015

(86) PCT No.: PCT/ES2015/070659
§ 371 (c)(1),
(2) Date: Mar. 14, 2017

(87) PCT Pub. No.: WO2016/042183
PCT Pub. Date: Mar. 24, 2016

(65) Prior Publication Data

US 2017/0254115 A1 Sep. 7, 2017

(30) Foreign Application Priority Data

Sep. 15, 2014 (ES) ..... 201431332

(51) Int. Cl.
*E05B 47/00* (2006.01)
*E05B 65/46* (2017.01)
(Continued)

(52) U.S. Cl.
CPC ..... *E05B 47/0001* (2013.01); *E05B 17/2034* (2013.01); *E05B 47/0012* (2013.01);
(Continued)

(58) Field of Classification Search
CPC ..... E05B 47/0012; E05B 47/026; E05B 2047/0031; E05B 2047/002;
(Continued)

(56) References Cited

U.S. PATENT DOCUMENTS 2,299,646 A * 10/1942 Muller ..... E05B 47/0607 200/43.12
3,234,766 A * 2/1966 O'Brien ..... E05B 43/005 292/144
(Continued)

FOREIGN PATENT DOCUMENTS

EP 0949597 A2 10/1999
EP 2141311 A1 1/2010
(Continued)

*Primary Examiner* — Lloyd A Gall
(74) *Attorney, Agent, or Firm* — The Webb Law Firm

(57) ABSTRACT

An electronic lock defines an open position and a closed position and includes a mobile carriage moveable in a linear manner. The mobile carriage is coupled to a closure element and to an actuation mechanism. A first spring is provided between the mobile carriage and the closure element and is configured to move in relation to the mobile carriage. A lock sensor is provided for controlling the position of the closure element. An electronic control module is connected to the sensor for identifying non-authorized manipulations of the lock when it should be closed. The lock sensor detects when the closure element is in the open position or, if it should be open, the lock sensor does not detect when the closure element is in the open position.

12 Claims, 5 Drawing Sheets

(51) Int. Cl.
*E05B 47/02* (2006.01)
*E05B 65/44* (2006.01)
*E05B 17/20* (2006.01)

(52) U.S. Cl.
CPC ..... *E05B 47/026* (2013.01); *E05B 65/44* (2013.01); *E05B 65/46* (2013.01); *E05B 17/2015* (2013.01); *E05B 2047/002* (2013.01); *E05B 2047/0016* (2013.01); *E05B 2047/0031* (2013.01); *E05B 2047/0067* (2013.01); *E05B 2047/0068* (2013.01); *E05B 2047/0069* (2013.01)

(58) Field of Classification Search
CPC ..... E05B 2047/0016; E05B 2047/0068; E05B 47/0001; E05B 65/46; E05B 17/2034; E05B 65/44; E05B 17/2015; E05B 2047/0067; E05B 2047/0069
USPC ..... 70/182–186, 252, 432, 267–271, 277, 70/278.7, 279.1, 280–282; 292/144, 153
See application file for complete search history.

(56) References Cited

U.S. PATENT DOCUMENTS 3,629,818 A * 12/1971 Hirama ..... B60R 25/02126 180/287
3,767,240 A * 10/1973 Belanger ..... E05B 47/0012 292/144
3,792,888 A * 2/1974 Kambic ..... E05B 47/0002 292/144
4,634,155 A 1/1987 Geringer et al.
5,339,662 A * 8/1994 Goldman ..... E05B 47/0002 70/277
5,718,132 A * 2/1998 Riefe ..... B60R 25/02105 180/277
5,927,769 A 7/1999 Pullen
6,016,677 A 1/2000 Clark
6,324,878 B1 * 12/2001 Ramamurthy .... B60R 25/02153 292/144
6,354,118 B1 * 3/2002 Frick ..... B60R 25/02153 70/186
6,516,640 B2 * 2/2003 Jacobs ..... B60R 25/02128 70/186
6,675,673 B2 * 1/2004 Starken ..... B60R 25/02153 70/186
6,813,916 B2 * 11/2004 Chang ..... E05B 47/0012 292/144
7,007,525 B2 * 3/2006 Okuno ..... B60R 25/02153 70/186
7,021,093 B2 * 4/2006 Fukatsu ..... B60R 25/02153 70/186
7,059,159 B2 * 6/2006 Lanigan ..... B62D 33/0222 292/144
7,140,213 B2 * 11/2006 Feucht ..... B60R 25/02153 70/186
7,151,324 B2 * 12/2006 Neuhoff ..... B60R 25/02153 307/10.2
7,647,797 B1 * 1/2010 Viso Cabrera ..... E05B 47/0012 292/144
7,703,309 B2 * 4/2010 Okuno ..... B60R 25/02153 384/202
7,762,110 B2 * 7/2010 Tsukazaki ..... B60R 25/02153 70/186
7,775,072 B2 * 8/2010 Pullmann ..... E05B 15/101 292/144
8,291,733 B2 * 10/2012 Chiou ..... E05B 47/0661 292/279
8,494,680 B2 * 7/2013 Sparenberg ..... E05B 47/026 292/144
2004/0182121 A1 * 9/2004 Fukatsu ..... B60R 25/02153 70/186
2007/0006620 A1 * 1/2007 Fukushima ..... B60R 25/0211 70/186
2008/0178643 A1 * 7/2008 Okuno ..... B60R 25/02153 70/184
2009/0007612 A1 * 1/2009 Laval ..... B60R 25/02142 70/271
2010/0000273 A1 1/2010 Viso Cabrera et al.
2010/0000274 A1 * 1/2010 Viso Cabrera ..... E05B 17/22 70/278.7
2010/0206020 A1 * 8/2010 Chen ..... B60R 25/02153 70/210
2010/0212377 A1 * 8/2010 Graglia ..... B60R 25/02153 70/183
2011/0066288 A1 * 3/2011 Sparenberg ..... E05B 47/026 700/275
2012/0260701 A1 * 10/2012 Okada ..... B60R 25/02153 70/183
2014/0225488 A1 8/2014 Zabala Zabaleta
2016/0281401 A1 * 9/2016 Liu ..... E05B 47/06

FOREIGN PATENT DOCUMENTS

EP 2767657 A2 8/2014
ES 2314336 T3 3/2009
ES 2384284 T3 7/2012

* cited by examiner

ELECTRONIC LOCK

CROSS-REFERENCE TO RELATED APPLICATIONS

This application is the United States national phase of International Application No. PCT/ES2015/070659 filed Sep. 11, 2015, and claims priority to Spanish Patent Application No. P201431332 filed Sep. 15, 2014, the disclosures of which are hereby incorporated in their entirety by reference.

FIELD OF THE INVENTION

The present invention refers to an electronic lock for lockers and furniture; and in general for doors, drawers and other items that need to be closed by means of a closure element integrated in the lock, so that the lock which is the object of the invention provides optimum security conditions against non-authorised attempts to open the lock and against undesired blockages. The present invention includes an electronic control system guaranteeing that the lock opens and closes, and for detecting when it is blocked or when a non-authorised manipulation of the lock takes place.

BACKGROUND OF THE INVENTION

Currently, the electronic locking devices commonly used in the locks of the doors of lockers and furniture, and even in access doors, have a mechanism that is activated when a key is introduced or placed close to it, such as proper code or an electronic card, or they are activated remotely, moving a closure element to an open or closed position.

The problem with these locks appears when an obstacle gets in the way of the closure element, preventing it from freely coming out of the interior of the closure mechanism, and therefore inadequately closing the door wherein it is installed. Moreover, in the case of furniture or doors with incorrectly fitted fixed parts (the structure or frame of the furniture) and mobile parts (door, drawer, etc.), the closing operation would create friction on the closure element, impeding its free movement or even its capacity to come out of the lock if it were to abut against the side of the structure or frame.

In addition, there are currently no electronic locks as the one described in the present invention, which have a mechanism to detect whether a lock has been or is in the process of being forced open, and to detect problems with the movement of the latch or closure element due to friction or objects getting in its way.

Therefore, the technical problem addressed is to provide an electronic system for a lock that has a mechanism to detect whether it has been or is in the process of being forced open, and to detect in real time if the closing mechanism successfully completes the operation or if there are any obstacles preventing it from closing, that is, if the closure element is being blocked by an object when the lock is closing, therefore preventing the aforementioned lock from actually closing.

DESCRIPTION OF THE INVENTION

In order to reach the goals and avoid the drawbacks mentioned in the paragraphs above, the invention described herein proposes an electronic lock including a closure element moveable by an actuation mechanism. The movement of the closure element defines at least an open position and a closed position of the electronic lock.

The electronic lock also includes a mobile carriage defining a closed position and an open position. The mobile carriage is coupled on one end to the closure element and on the other end to the actuation mechanism.

A first elastic element is provided between the mobile carriage and the closure element and is moveable in relation to the mobile carriage in the same direction the mobile carriage is moving.

A lock sensor is connected to an electronic control module that controls the position of the closure element and detects when the closure element is totally or partially in the open position.

The electronic control module controls the actuation mechanism of the lock, which is configured to identify non-authorised manipulations of the lock after the closure element has been given the order to close the lock and the lock sensor detects that the closure element is in the open position or after the closure element has been given the order to open the lock and the lock sensor does not detect that the closure element is in the open position, which means that it is in the closed position.

In addition, if the electronic control module detects that the lock has been manipulated, it will trigger a local alarm (for example a buzzer or a visual or sound alarm) or a remote alarm (through messages or warnings sent by remote wired or wireless communication).

The closure element is in charge of activating the lock sensor so that when the closure element is in the closed position it deactivates the lock sensor, which in turn is connected to the electronic control module so that said module is aware that the closure element is in the closed position, whereas in the open position the closure element activates said lock sensor so that said module is aware that the closure element is in the open position.

In a particular embodiment of the invention, the electronic control module includes a timer that is activated after the electronic control module sends the order to close or to open the closure element. This timer adds a predetermined delay between the time the order is sent and the check that the lock sensor performs to detect or fail to detect whether the closure element is in the open position or not. This delay will generally be a few seconds and will give the inner mechanism of the lock the time to open or close the closure element, after which, if a non-authorised manipulation of the lock is detected, the electronic control module will take the necessary measures to protect the internal mechanism of the lock and/or trigger the alarms.

In another particular embodiment of the invention, the electronic lock includes a closure sensor connected to the electronic control module that detects when the mobile carriage is in the closed position. This allows the electronic control module to identify non-authorised manipulations of the electronic lock when the closure sensor simultaneously detects that the mobile carriage is in the closed position and the lock sensor detects that the closure element is not in the closed position.

In another particular embodiment of the invention, the electronic lock further includes an opening sensor connected to the electronic control module that detects when the mobile carriage is in the open position. This allows the electronic control module to identify non-authorised manipulations of the electronic lock when the opening sensor simultaneously detects that the mobile carriage is in the open position and the lock sensor detects that the closure element is not in the open position.

These opening and closure sensors of the mobile carriage can be integrated together in the lock, either complementary to each other or independently.

The mobile carriage is the element in charge of activating the closing and opening sensors. When the mobile carriage is in the open position, it activates the opening sensor which in turn is connected to the electronic control module so that said module is aware that the mobile carriage is in the open position. When the mobile carriage is in the closed position, it activates the closure sensor which in turn is connected to the electronic control module so that said module is aware that the mobile carriage is in the closed position.

In another embodiment of the invention, the electronic lock also includes a male element coupled to the mobile carriage by a second elastic element, where the male element can move in relation to the mobile carriage in the same direction the mobile carriage is moving and a locking latch that turns around an axis defining a locked position and an unlocked position such that when the closure element is in the open position, the locking latch goes into the unlocked position, and when the closure element is in the closed position, the locking latch is located between the closure element and the male element, blocking the locking latch and the movement of the closure element, with the male element acting as a stop for the locking latch. Therefore, when the locking latch is in the locked position and tries to forcefully move the closure element from the closed position to the open position, the closure element stops against the locking latch, which in turn stops against the male element, preventing the closure element from moving to the open position.

The closure element includes an end portion shaped like a bolt so that in the open position of the electronic lock, the end portion is placed in the interior of the electronic latch, while in the closed position of the electronic lock, the end portion protrudes from the housing that includes and protects the electronic lock. It is this end portion that ultimately closes and opens the lock.

In another embodiment of the invention, the locking latch is not directly touching the closure element when it is in its locked position. This space between them allows the closure element to have a slight degree of movement in relation to the mobile carriage. This movement of the closure element from the closed position to the open position until the closure element stops against the locking latch makes the lock sensor change its state, allowing the control module to identify that there is a non-authorised manipulation of the lock taking place. This situation would correspond to an attempt to force open the lock from the outside when the closure element is pushed inside the electronic lock. Optionally, the electronic control module can trigger a local or remote alarm to notify about the non-authorised manipulation.

In another embodiment of the present invention, the actuation mechanism includes an engine with an axis fixed to a gear connected to a cog that is integrated on the mobile carriage. Therefore, when the gear turns it pulls the mobile carriage linearly in one direction or another depending on the direction the gear is turning. However, any other means of adequate dimensions for actuating the mobile carriage that is capable of moving said carriage from the open position to the closed position would be perfectly valid. For example, the means for actuating the carriage could also be an engine with an axis fixed to a cam making the mobile carriage move or a solenoid with an axis making the mobile carriage move.

Optionally, the electronic lock could also have a mechanism to automatically open the closure element when it detects that a non-authorised manipulation of the electronic lock is taking place. Therefore, when the lock is being forced open, the electronic module orders the closure element to open in order to prevent the manipulation attempt from damaging the internal mechanism of the lock itself. This solution would also trigger a local or remote alarm to warn that a manipulation has taken place.

In another embodiment of the present invention, the lock is integrated inside a housing.

In another embodiment of the present invention, the axis of the locking latch is fixed to the encasing axis of the lock. This encasing can be that of the housing or a lid of the lock.

The first and second elastic elements could also be located inside a cylinder made of flexible material and a slightly wider diameter in relation to the width of said elements to prevent said springs from moving sideways when they are compressed by the closure element and the male element respectively.

Therefore, the innovative electronic lock described previously provides a more reliable and safer solution against potential manipulations compared to other existing locks.

Therefore, in the embodiment that features closing and opening sensors, when the closure element is in the open position and an obstacle gets in the way to prevent the closure element from coming out of the lock, when the order to close the lock is given and the lock goes from the open to the closed position, the mobile carriage moves to the closed position sending information about its new state to the electronic control module via the closure sensor, which is activated, and the opening sensor, which is deactivated. The closure element cannot move forward due to the obstacle blocking it, causing the first spring to compress absorbing the movement of the mobile carriage, thus keeping the lock sensor activated. Similarly, the locking latch cannot turn on its axis since the closure element prevents it from doing so. When this happens, the male element touching the locking latch compresses the second spring, which also absorbs the movement of the mobile carriage.

While the obstacle is present, thanks to the various sensors the system is able to know in real time that the closure element of the lock is electronically closed yet not mechanically closed, since the closure sensor is being activated by the mobile carriage that has correctly moved to the closed position but the lock sensor remains activated since the closure element cannot move to the closed position due to the aforementioned obstacle.

Once the obstacle disappears, the closure element moves to the closed position pushed by the first spring; simultaneously the male element moves the locking latch to its locked position with the aid of the second spring, since the closure element is no longer touching it and preventing it from moving.

When this happens, the system recognizes in real time that the obstacle is no longer present since the lock sensor detects it, without needing any other external means to the lock nor the intervention of the user.

In a similar fashion, if the closure element is held from the outside when the order to open the lock is sent, the closure element will not go inside the housing. Therefore, the opening sensor will activate when it detects the mobile carriage moving to the open position while the lock sensor still detects the "lock" since the closure element is being held and thus has not been able to move in order to change its state. This means that the lock is electronically open but not mechanically open. When this happens the electronic control module detects that the lock has been manipulated, and optionally it can activate an alarm to warn about it and/or perform other actions. Once the closure element is freed, the tension of the first spring will move said closure element to the correct open position.

When the electronic control module identifies the non-authorised manipulation of the lock, the module can choose between keeping the lock closed or opening it. If, for example, the lock is in the closed position and is externally manipulated in order to open it by forcefully pushing the closure element inside the lock, the electronic control module can opt to open the lock in order to prevent it from breaking. Similarly, if the manipulation is performed by holding the closure element when the order has been given to open the lock, in order to prevent the lock from opening, the electronic control module con opt to give the order to close the lock in order prevent the lock from getting damaged.

According to this description, when the electronic lock is operating normally, no problems should arise since the mechanism to detect unexpected anomalies provides the electronic lock with added security, where the unexpected anomalies are detected by the three sensors sending signals to a control module in order to trigger an alarm or notify headquarters about the attempt to force open the lock.

Therefore, the structure of the electronic lock, in addition to protecting it from manipulations, allows it to retrieve information in real time about it status, so that if the lock was forced, the electronic control module could send warnings, trigger an alarm or notify headquarters remotely or locally about the attempt to force open the lock.

In another embodiment of the invention, the electronic control module includes a memory that stores information about when the lock has been opened and closed. This information is retrieved by the opening, closing and lock sensors. The information may be related to the number of times it has closed and opened, the forcing attempts, the times of the day when the lock has opened and closed, etc.

In another embodiment of the invention, the mobile carriage defines the closed position and open position by a linear or turning movement.

In another embodiment of the invention, the first elastic element and the second elastic element may be springs and fluid shock absorbers or a combination thereof.

Hereinafter, in order to give a better understanding of the description, the invention has been detailed in a series of drawings that are an integral part of the report and are for illustration purposes and without limitation.

DESCRIPTION OF A SAMPLE EMBODIMENT

Considering the numbering adopted in the figures, the closing and opening device of the electronic lock has the following nomenclature used in the description:

1—Housing.
2—Mobile carriage.
3—Closure element.
3*a*.—End portion.
4—First spring.
5—Male element.
6—Second spring.
7—Engine.
8—Gear.
9—Cog.
10—Locking latch.
11—Axis.
12—Obstacle.
13—Lock sensor.
14—Closure sensor.
15—Opening sensor.
16—Electronic control module.
17—Timer.

The elements including the electronic lock are fixed inside a housing (1). The lock is fixed to a door or a similar element via the housing (1).

Figure 1:
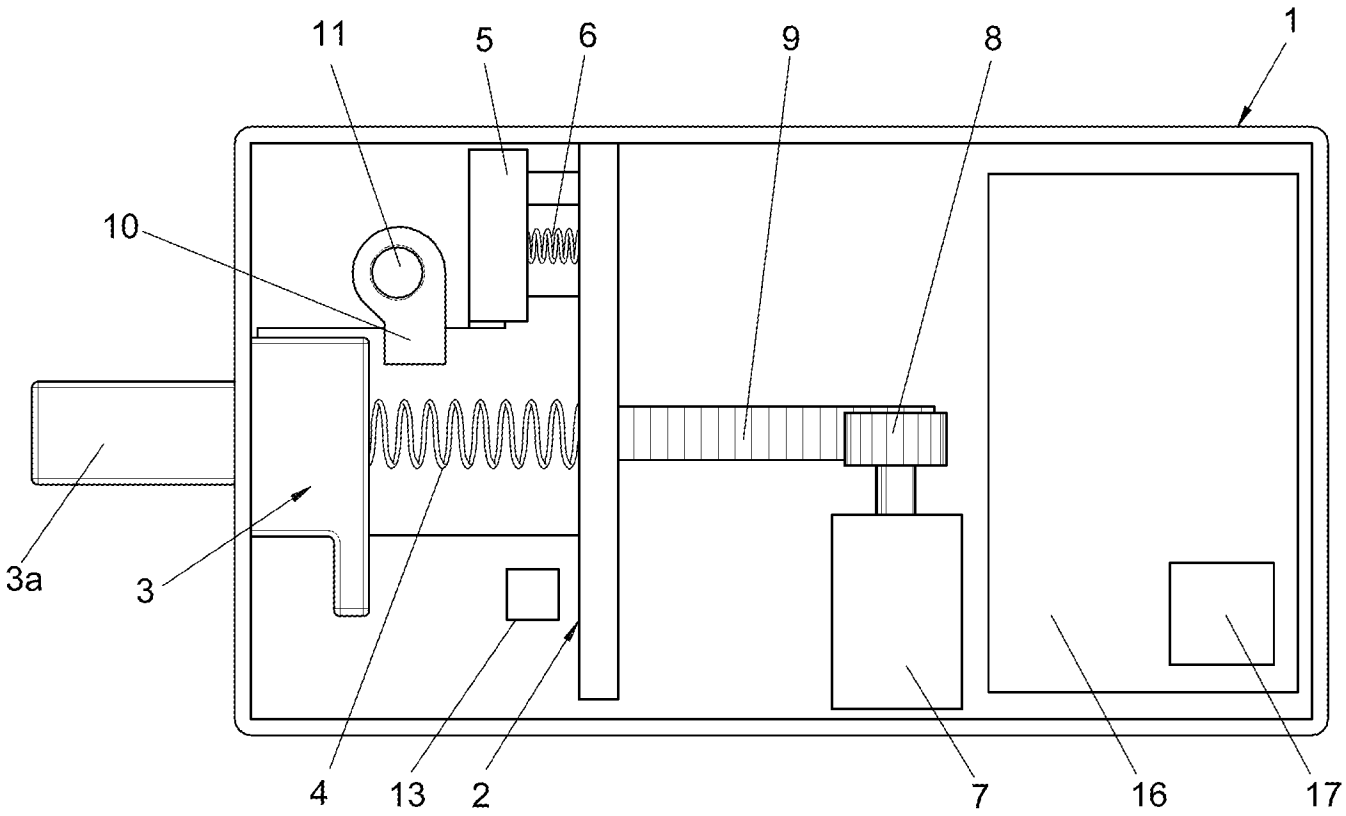
FIG. 1 shows a front view of a first embodiment of an electronic lock a closed position.

As shown on FIG. 1, the lock includes a mobile carriage (2) that can move in a linear manner in two directions, and is coupled to a closure element (3) that can move in relation to the mobile carriage (2) in the same direction the mobile carriage (2) is moving. This movement is relative thanks to a first spring (4) located between the mobile carriage (2) and the closure element (3).

The mobile carriage (2) is coupled to a male element (5) that can move in relation to the mobile carriage (2) in the same direction said mobile carriage (2) is moving. This movement is relative thanks to a second spring (6) located between the mobile carriage (2) and the male element (5).

The closure element (3) includes an end portion (3*a*) shaped like a bolt, which is in charge of locking the door when said end portion (3*a*) protrudes from the housing (1) of the lock.

The linear movement of the assembly of the mobile carriage (2), the closure element (3), and the male element (5) is carried out by an actuation mechanism located inside the housing. Optionally, the mobile carriage (2) and the closure element (3) can move along a series of guides in the housing that are the same for both components. Additionally, the male element (5) could also have its own guides in the housing.

In one of the embodiments, the actuation mechanism comprises an engine (7) with an axis fixed to a gear (8) connected to a cog (9) that is integrated on the mobile carriage (2), so that when the gear (8) turns it pulls the assembly of the mobile carriage (2), the closure element (3) and the male element (5) to the closed position or the open position, depending on the direction the gear (8) is turning.

In other embodiments that are not shown in the figures, the actuation mechanism of the mobile carriage (2) is, for example, a cam mechanism, a linear engine, etc.

Figure 2:
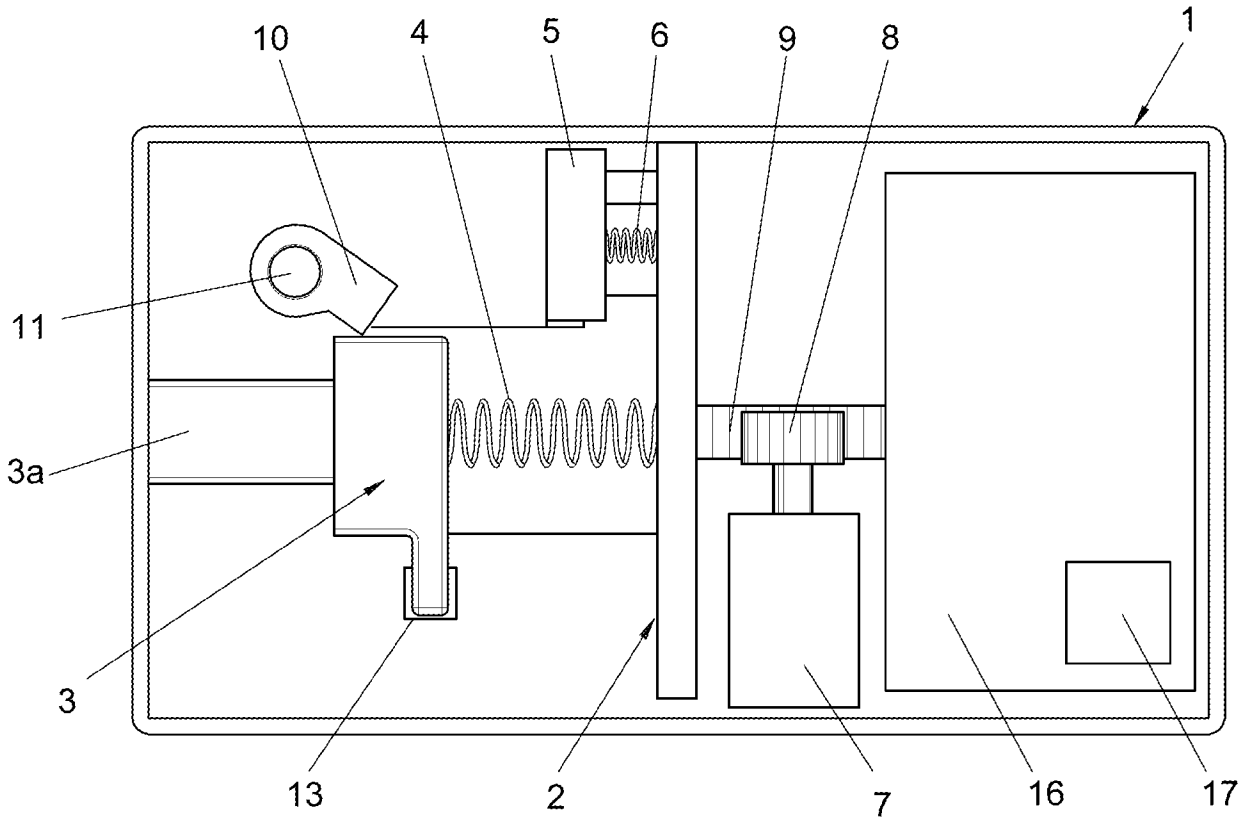
FIG. 2 shows a front view of the electronic lock of FIG. 1 in an open position.

The lock also includes a lock sensor (13) controlling the position of the closure element (3) at all times. When the electronic control module (16) sends the order to open or close the closure element (3), the module (16) only controls the position of said element (3) via the lock sensor (13), so that if the order given does not match the position of the closure element, the electronic control module (16) knows that a non-authorised manipulation of the lock is taking place. The electronic control module could also feature a programmable timer (17) that, once the order to open or close the closure element (3) is given, it triggers a predefined delay (1, 2, 3, 4 or 5 seconds, for example) between the time the order is sent and the moment in which the electronic control module (16) checks if the lock sensor (13) detects or does not detect the closure element to determine its position, and therefore, if the lock has been closed or opened accordingly. Therefore, for example when the lock is open (FIG. 2), the lock sensor (13) is detecting the closure element, which means that it is located inside the housing (1) and that the electronic lock is open. If the electronic control module (16) sends the order to close the lock (FIG. 1), the engine (7) activates and moves the mobile carriage (2), which in turn moves the closure element (3) to its closed position. Simultaneously the timer (17) is activated and once the predetermined delay time elapses, the module (16) checks if the lock sensor (13) is no longer detecting the closure element (3), as shown on FIG. 1, which means that the procedure of closing the lock has been completed successfully. If after the predetermined delay time, the sensor (13) still detects the closure element (3), or if an order to open the lock has not been given and the sensor (13) suddenly starts detecting the closure element (3), this would imply that a non-authorised manipulation of the lock is taking place.

This electronic control module (16) will be in charge of receiving the signals of the sensors, controlling the movement of the engine and managing and storing the information sent by the sensors.

The electronic lock also includes a locking latch (10) that turns around an axis (11) defining a locked position and an unlocked position of the locking latch (10). When the locking latch (10) is in its locked position, it prevents the closure element (3) from moving from the closed position to the open position, and later on we will explain how it operates.

When the electronic lock receives an order, whether because a code has been introduced in the lock or a card has been placed near it or from a distance, the lock is capable of interpreting whether it should open or close and when it should do so, that is, it analyses whether it should change its state so that it will open if it was closed and vice versa.

If the lock is operating correctly, when the electronic lock goes from the open position (FIG. 2) to the closed position (FIG. 1), the mobile carriage (2) moves via the engine (7) of the actuation mechanism, so that when said mobile carriage (2) reaches the locking latch (10), the male element (5) makes the locking latch (10) turn on its coupling axis (11) and adopt an intermediate position (locked position) between the male element (5) and the closure element (3). It should be highlighted that in the open position of the lock, the locking latch (10) is resting on the closure element (3).

Figure 3:
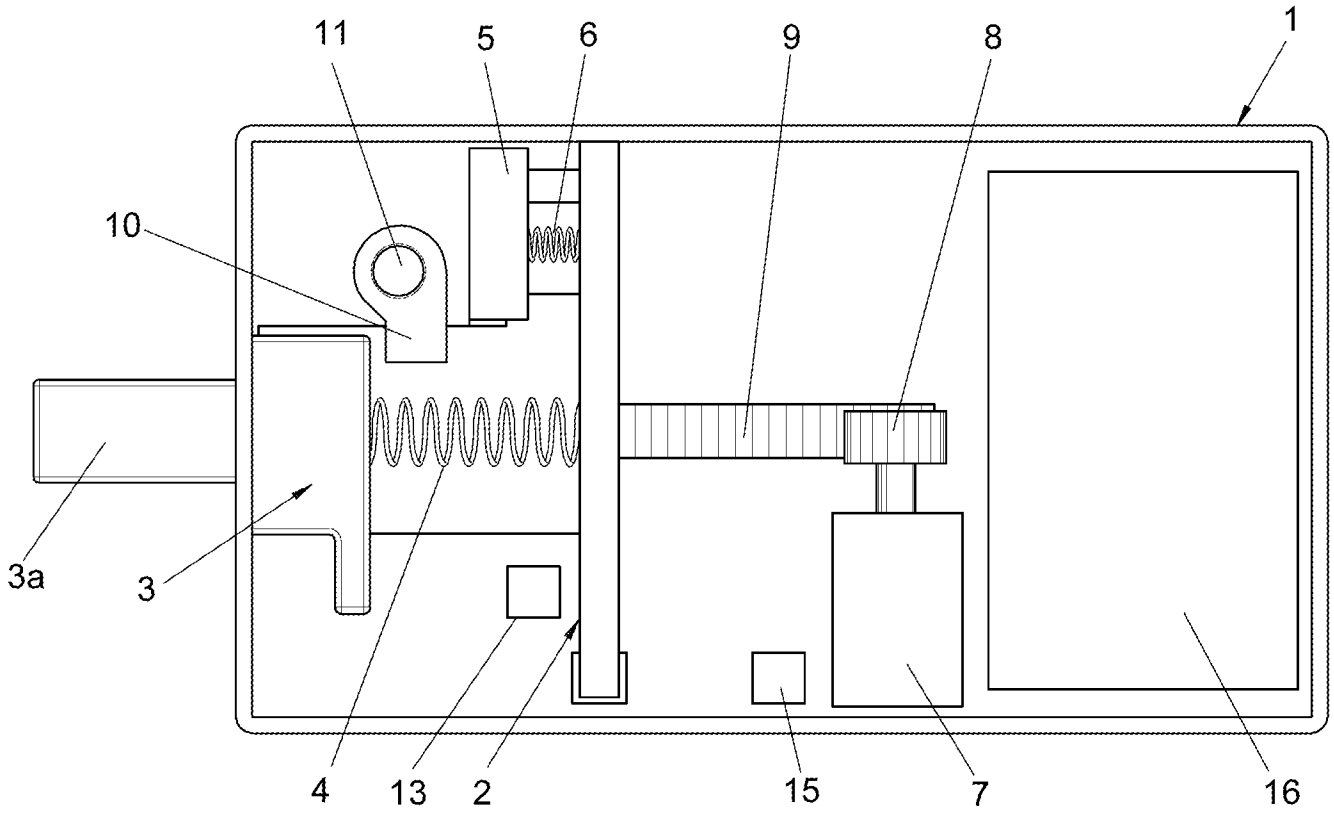
FIG. 3 shows a front view of a second embodiment of the electronic lock in the closed position.
Figure 4:
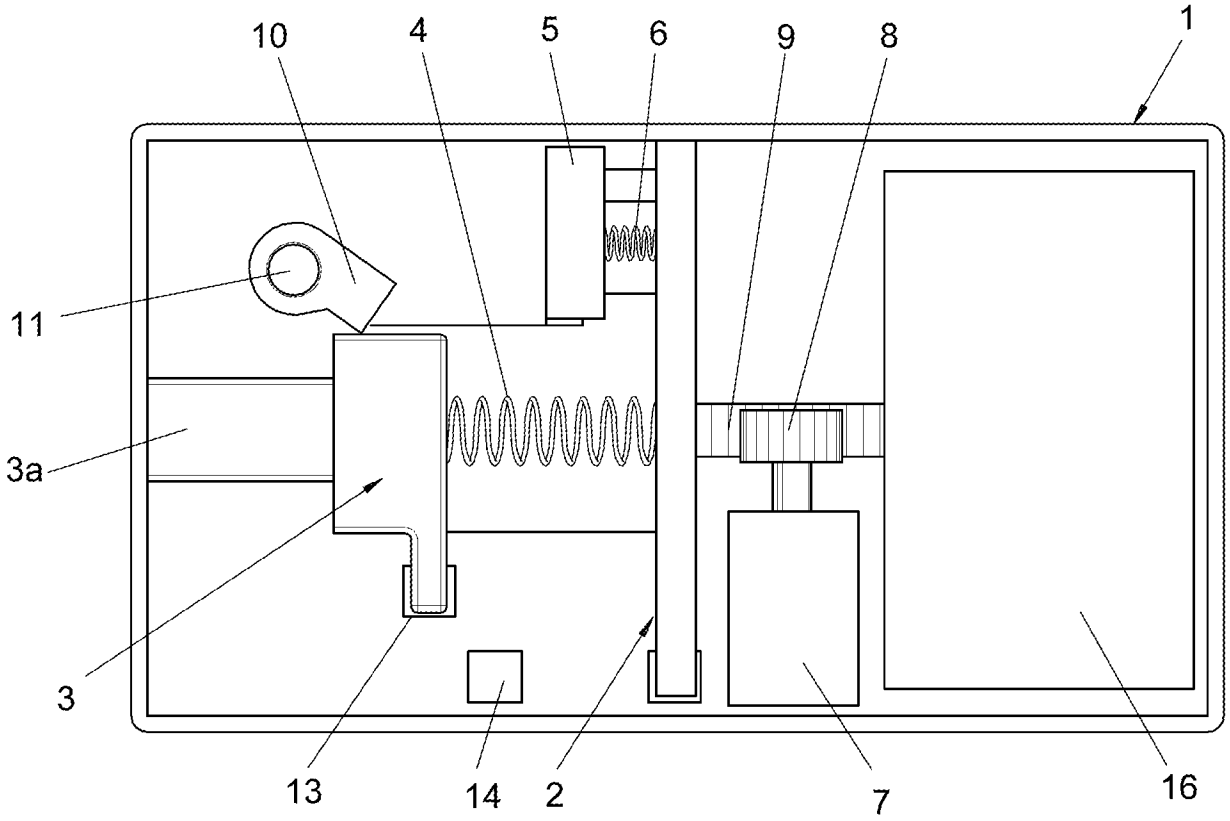
FIG. 4 shows a front view of the electronic lock of FIG. 3 in the open position.
Figure 5:
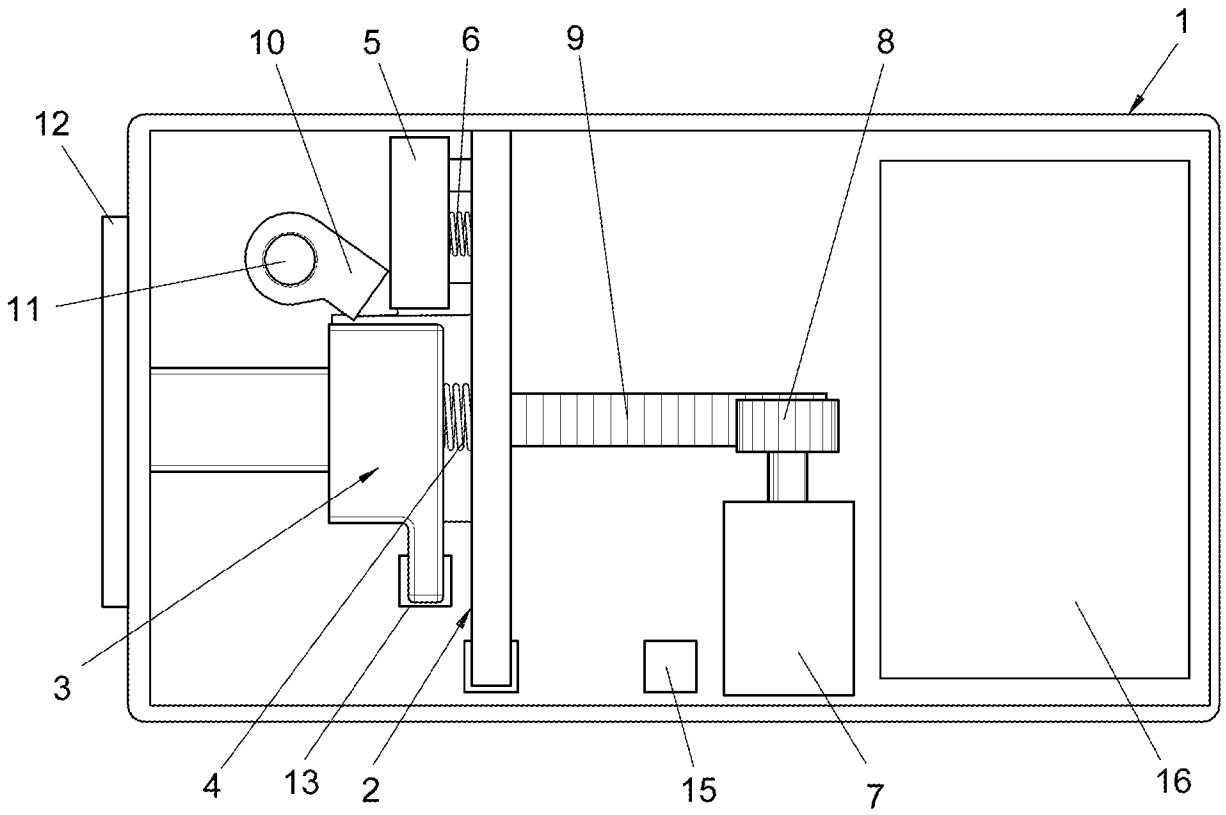
FIG. 5 shows another front view of the electronic lock of FIGS. 3 and 4, in which an obstacle is preventing a closure element from moving.

FIGS. 3 to 5 show another embodiment of the lock in which the lock also includes a closure sensor (14) and an opening sensor (15). The closing (14) and opening sensors (15) control the position of the mobile carriage (2). The mobile carriage (2) is facing the opening (15) and closing (14) sensors when it reaches the end positions, so that thanks to the sensors (14,15) it can know at all times if the mobile carriage (2) is or is not in the closed and open positions. In this example there could also be a programmable timer (not shown in the drawings) that adds a temporary delay that allows all the elements to move to their respective positions before the electronic control module (16) can check if there has been a non-authorised manipulation of the lock.

The electronic control module (16) can check that the lock is operating correctly in real time via the two sensors (14,15) and the lock sensor (13), so that the final correct position of the electronic lock is as follows: the closure sensor (14) detects the closed position of the mobile carriage (2) (FIG. 3), the opening sensor (15) does not detect the open position of the mobile carriage (2) and the lock sensor (13) detects that the closure element (3) has reached its correct position, that is, the closed position. It should be highlighted that when a sensor detects the position of an element it is because a part of the detected element is facing the respective sensor.

When the lock goes from the closed position (FIG. 3) to the open position (FIG. 4), the mobile carriage (2) moves and causes the locking latch (10) turn on its axis (11) due to the push generated by the closure element (3) on the locking latch (10) without there being any interaction with the male element (5) since this element would have moved already.

Equally, the open position can be checked by the two sensors (14,15) and the lock sensor (13), so that the final correct open position of the lock is as follows: the opening sensor (15) detects the open position of the mobile carriage (2), the lock sensor (13) does not detect the closed position of the closure element (3) in the open position and the closure sensor (14) does not detect the closed position of the mobile carriage (2).

Both the arrangement of the different elements as well as the sensors inside the housing (1) give versatility to the opening and closing device for all kinds of distances required for the open and/or closed positions.

Following, we will describe an abnormal operation of the electronic lock shown on FIGS. 3 and 4 due to three different situations.

In the first example, a situation is described in which when the lock is in the process of closing (FIG. 5), the closure element (3) meets an obstacle (12), the second example describes a situation in which a non-authorised manipulation of the lock takes place by trying to forcefully introduce the closure element (3) inside the housing (1), and the third example describes a situation in which the closure element (3) is held outside the housing (1) when the electronic control module (16) has sent the order to open the lock.

If an obstacle (12) stands in the way of the closure element (3) (see FIG. 5), when the order to close the lock is given and therefore it goes from the open position to the closed position, the mobile carriage (2) moves to the closed position, sending information about its new state to the electronic control module (16) by the closing (14) and opening sensors (15). In this situation, the lock sensor (13) detects that the closure element (3) is not in the closed position, the closure sensor (14) detects that the mobile carriage (2) is in the closed position and the opening sensor (15) detects that the mobile carriage (2) is not in the open position. Additionally, since the closure element (3) cannot move forward due to the blockage caused by the obstacle (12), it compresses the first spring (4). Similarly, the locking latch (10) cannot turn on its axis (11) since the closure element (3) prevents it from doing so. When this happens, the male element (5) that touches the locking latch (10) compresses the second spring (6).

This system of springs ensures that no other element of the electronic lock is damaged due to stresses.

With the obstacle still blocking the mechanism, the system can check in real time thanks to its various sensors that the electronic lock is electronically closed but not mechanically closed since the lock sensor (13) has not sent the information about the closure of the lock, that is, the lock sensor (13) is detecting that the closure element (3) is not in the correct closed position.

Once the obstacle (12) disappears, the closure element (3) moves to the closed position pushed by the first spring (4); simultaneously the male element (5) moves the locking latch (10) to its locked position with the aid of the second spring (6), since the closure element (3) is no longer touching it and preventing it from moving. When this happens, the system recognises in real time that the obstacle (12) is no longer present since the lock sensor (13) detects that the closure element (3) is in the correct position, without needing any other external means to the lock nor the intervention of the user.

In the second example related to the manipulation attempt of the lock, when the closure element (3) is in the closed position (FIGS. 1 and 3), the locking latch (10) ends up located between the closure element (3) and the male element (5). This means that if a non-authorised forced opening of the lock takes place by pushing the closure element (3) inside the housing (1), the locking latch (10) together with the male element (5) stop the closure element (3), preventing it from opening.

In an attempt to manipulate the closure element (3), it would move until it stops against the locking latch (10), which prevents it from opening, moving enough so that this movement can be detected by the lock sensor (13), which is registered by the electronic control module (16). The electronic control module (16) will be able to trigger a local or remote alarm.

The third anomalous situation that could take place is when the closure element (3) is held from the outside when the order is sent to the lock to switch from the closed position to the open position. When this happens, the mobile carriage (2) moves to the open position activating the opening sensor (15), but the lock sensor (13) does not detect the closure element (3) since the closure element (3) is being held, and therefore remains inactive. Then the electronic control module (16) interprets that the closure element (3) is being held, registering the event in its internal memory and triggering a local or remote alarm.

When said closure element (3) is freed, the tension of the first spring (4) pulls said closure element (3) moving it to the correct open position, activating the lock sensor (13) and notifying the control module (16).

Therefore, the electronic lock that is the object of the invention, in addition to protecting itself from manipulations, is able to retrieve information in real time about its status so that if it detects that the lock is being forced, it can trigger an alarm or notify headquarters about the attempt to force open the lock.

Similarly, the sensors can retrieve information about the electronic lock such as the number of times it has been opened and closed, the attempts to force it open, the times of the day when it has been opened and closed, etc.

The invention claimed is:

1. An electronic lock comprising a closure element moveable by an actuation mechanism, the electronic lock defining at least an open position and a closed position and comprising:

a mobile carriage defining an open position and a closed position, wherein the mobile carriage is coupled on one end to the closure element and to the actuation mechanism on an opposite end;

a first elastic element located between the mobile carriage and the closure element, the first elastic element configured to move in relation to the mobile carriage and in the same direction the mobile carriage is moving;

a lock sensor connected to an electronic control module for controlling the position of the closure element and detecting when the closure element is at least partially in the open position;

a male element coupled to the mobile carriage by a second elastic element, the male element configured to move in relation to the mobile carriage and in the same direction as the mobile carriage; and a locking latch that turns about an axis defining a locked position and an unlocked position; so that when the closure element is in the open position, the locking latch goes into the unlocked position, while when the closure element is in the closed position, the locking latch is located between the closure element and the male element, blocking the locking latch and the movement of the closure element, with the male element acting as a stop for the locking latch, wherein the electronic control module controls the actuation mechanism and is configured to identify, by the lock sensor, situations in which after the closure element has been given an order to close the lock, the lock sensor detects that the closure element is in the open position, or situations in which after the closure element has been given an order to open the lock, the lock sensor does not detect that the closure element is in the open position.

2. The electronic lock according to claim 1, wherein the electronic control module comprises a timer that is activated after the electronic control module sends the order to close or open the closure element in order to add a predetermined delay between a time the order is sent and a check that the lock sensor performs to detect whether the closure element is in the open position.

3. The electronic lock according to claim 1, further comprising a closure sensor connected to the electronic control module that detects when the mobile carriage is in the closed position, so that the electronic control module can identify situations in which simultaneously the closure sensor detects that the mobile carriage is in the closed position and the lock sensor detects that the closure element is in the open position.

4. The electronic lock according to claim 1, further comprising an opening sensor connected to the electronic control module that detects when the mobile carriage is in the open position, so that the electronic control module can identify situations in which simultaneously the opening sensor detects that the mobile carriage is in the open position and the lock sensor detects that the closure element is not in the open position.

5. The electronic lock according to claim 1, wherein the actuation mechanism is selected between:

an engine with an axis fixed to a gear connected to a cog, such that as the gear turns it moves the mobile carriage in one direction or the other depending on the direction the gear is turning;

an engine with an axis fixed to a cam making the mobile carriage move; and, a solenoid with an axis making the mobile carriage move.

6. The electronic lock according to claim 1, wherein the locking latch is spaced from the closure element when in the locked position, allowing the closure element to have a slight degree of movement in relation to the mobile carriage; wherein the movement of the closure element is detected by the lock sensor, allowing the electronic control module to identify this movement of the closure element.

7. The electronic lock according to claim 1, wherein the electronic control module automatically opens the lock when it detects situations in which after the closure element has been given the order to close the lock, the lock sensor detects that the closure element is in the open position, or situations in which after the closure element has been given the order to open the lock, the lock sensor does not detect that the closure element is in the open position.

8. The electronic lock according to claim 1, wherein the electronic control module triggers a local or remote alarm when it detects situations in which after the closure element has been given the order to close the lock, the lock sensor detects that the closure element is in the open position, or situations in which after the closure element has been given the order to open the lock, the lock sensor does not detect that the closure element is in the open position.

9. The electronic lock according to claim 1, wherein the lock is integrated inside a housing.

10. The electronic lock according to claim 1, wherein the electronic control module comprises a memory that stores information about when the lock has been opened and closed.

11. The electronic lock according to claim 1, wherein the mobile carriage defines the closed position and open position by a linear or turning movement.

12. The electronic lock according to claim 1, wherein the first elastic element and the second elastic element are springs or fluid shock absorbers or a combination thereof.

* * * * *